US005122706A

United States Patent [19]

Parrott et al.

[11] Patent Number: 5,122,706

[45] Date of Patent: Jun. 16, 1992

[54] ARC LAMP ASSEMBLY WITH CONTAINMENT MEANS SURROUNDING LIGHT SOURCE CAPSULE

[75] Inventors: Richard A. Parrott, Merrimack; Edward H. Nortrup, Bedford, both of N.H.

[73] Assignee: GTE Products Corporation, Danvers, Mass.

[21] Appl. No.: 580,489

[22] Filed: Sep. 11, 1990

[51] Int. Cl.[5] ..... H01J 61/34; H01J 61/52

[52] U.S. Cl. ..... 313/25; 313/634

[58] Field of Search ..... 313/25, 634

[56] References Cited

U.S. PATENT DOCUMENTS

| | | | |
|---|---|---|---|
| 3,138,731 | 6/1964 | Beese | 313/25 X |
| 3,250,934 | 5/1966 | Peterson | 313/634 X |
| 4,721,876 | 1/1988 | White et al. | 313/25 X |
| 4,918,352 | 4/1990 | Hess et al. | 313/25 |
| 4,961,019 | 10/1990 | White et al. | 313/25 |

*Primary Examiner*—Palmer C. DeMeo
*Attorney, Agent, or Firm*—Joseph S. Romanow

[57] ABSTRACT

A metal halide arc lamp assembly has a configuration which provides improved containment performance in the event that the arc tube bursts. The lamp assembly includes a metal halide arc tube, a cylindrical quartz shroud surrounding the arc tube and a sealed outer envelope enclosing the shroud and the arc tube. The arc tube has press seals with a generally I-shaped cross section. The maximum dimension of the press seals perependicular to the arc tube axis is not substantially greater than the maximum dimension of the bulb portion of the arc tube. The spacing between the outside surface of the bulb portion and the inside surface of the shroud is not greater than about three millimeters.

4 Claims, 1 Drawing Sheet

ARC LAMP ASSEMBLY WITH CONTAINMENT MEANS SURROUNDING LIGHT SOURCE CAPSULE

FIELD OF THE INVENTION

This invention relates to electric lamps and, more particularly, to double enveloped lamps which can be safely operated without the need for enclosing the lamp within a protective fixture, even in the event of a burst of the arc tube.

BACKGROUND OF THE INVENTION

Electric lamps known as double enveloped lamps include a light-source capsule, or arc tube, and an outer envelope surrounding the light source capsule. Metal halide arc lamps are examples of double-enveloped lamps. In such double enveloped lamps, there is a small probability that the light source capsule will burst. When such an event occurs, hot fragments of lass, or shards, and other capsule parts emanating from the burst capsule are forcibly propelled against the outer envelope. If the outer envelope also shatters, there is a potential safety hazard to persons or property in the immediate surroundings. Failure of the outer envelope is known as a containment failure.

One way to avoid the safety hazard of containment failure is to operate the lamp within a protective fixture that is capable of containing such a failure. However, a protective fixture usually incurs additional cost, particularly when an existing fixture must be modified or replaced. Furthermore, a protective fixture reduces the light output of the lamp, and it may be more difficult and expensive to replace the lamp in a protective fixture.

A preferred solution to the containment failure problem is a lamp assembly capable of self containment. One known self containment technique is to make the outer envelope sufficiently strong to contain the shattered light source capsule. An outer envelope having a relatively thick wall in combination with a light source capsule having a relatively thin wall is disclosed in U.S. Pat. No. 4,598,225 issued Jul. 1, 1986 to Gagnon. Another prior art technique is to shield the outer envelope from the effects of a burst light-source capsule. In U.S. Pat. No. 4,580,989 issued Apr. 8, 1986 to Fohl et al, a light-transmissive enclosure, or shield, located within an outer envelope surrounds a light source capsule and shields the outer envelope. See also U.S. Pat. No. 4,281,274 issued Jul. 28, 1981 to Bechard et al. Still another technique for containment is to reinforce the shield or the light-source capsule. In U.S. Pat. No. 4,721,876 issued Jan. 26, 1988 to White et al, a light-transmissive shield is reinforced by a cloth like wire mesh. Wire mesh reinforcement of a light-source capsule is disclosed in U.S. Pat. No. 4,625,140 issued Nov. 25, 1986 to Gagnon. Containment techniques are also disclosed in U.S. Pat. No. 4,888,517 issued Dec. 19, 1989, U.S. Pat. No. 4,942,330 issued Jul. 17, 1990 and in pending application Ser. No. 07/468,042 filed Jan. 20, 1990, all assigned to the assignee of the present application.

Guards for protecting incandescent lamps are disclosed in U.S. Pat. Nos. 314,208 issued Mar. 18, 1885 to White, 765,568 issued Jul. 19, 1904 to Eisenmann and 781,391 issued Jan. 31, 1905 to Blake.

While the above referenced containment techniques are highly effective for some lamp types and sizes, they may have disadvantages when applied to other lamp types and sizes. For example, the use of a thick walled outer envelope is effective for relatively small lamps but adds to the cost of the lamp. Lamps of greater than about 400 watts having a thick walled outer envelope are so heavy that there is a possibility that the lamp base will fail, leading to the lamp falling out of the light fixture. Furthermore, thick-walled outer envelopes of large physical size are difficult to fabricate. Various wire mesh containment devices are effective in achieving containment but add to the cost of the lamp and block a portion of its light output. Quartz shields, or shrouds, between the arc tube and the outer envelope are also effective in achieving containment. However, the shroud disturbs the thermal environment of the arc tube. Thus, the arc tube and the structures surrounding it must be carefully designed for proper lamp operation.

It is a general object of the present invention to provide improved double-enveloped lamps.

It is another object of the present invention to provide improved double enveloped lamps which can be safely operated without a protective fixture.

It is a further object of the present invention to provide self-containing, double enveloped lamps which have a high luminous output.

It is still another object of the present invention to provide improved metal halide arc discharge lamps.

It is a further object of the present invention to provide self-containing, double enveloped lamps which are light in weight and low in cost.

SUMMARY OF THE INVENTION

According to the present invention, these and other objects and advantages are achieved in a double-enveloped lamp assembly comprising a light-source capsule subject to burst on rare occasions, the light source capsule including a bulb portion that encloses a discharge region and press seals at opposite ends of the bulb portion, containment means for absorbing and dissipating a portion of the energy when the light source capsule bursts, the containment means comprising a light transmissive shroud which is spaced no more than about three millimeters from the bulb portion of the light source capsule, a light transmissive outer envelope enclosing the light source capsule and the shroud, and means for coupling electrical energy to the light source capsule. The light-source capsule is typically a metal halide arc tube.

Preferably, the maximum dimension of each press seal perpendicular to a longitudinal axis of the arc tube is not substantially greater than the maximum dimension of the bulb portion perpendicular to the arc tube axis. The press seals preferably have an I-shaped cross section. The press seal configuration of the present invention provides improved containment and permits use of a shroud with a relatively small inside diameter and a relatively thick wall.

The lamp assembly of the present invention provides improved containment performance in comparison with prior art lamp assemblies. In addition, the lamp assembly of the present invention reduces the possibility that the arc tube will burst when the arc tube material expands or bulges, since the bulge contacts the shroud, and the arc tube fails in a passive mode.

BRIEF DESCRIPTION OF THE DRAWINGS

For a better understanding of the present invention, together with other and further objects, advantages and capabilities thereof, reference is made to the accompanying drawings which are incorporated herein by reference and in which.

DETAILED DESCRIPTION OF THE INVENTION

Figure 1:
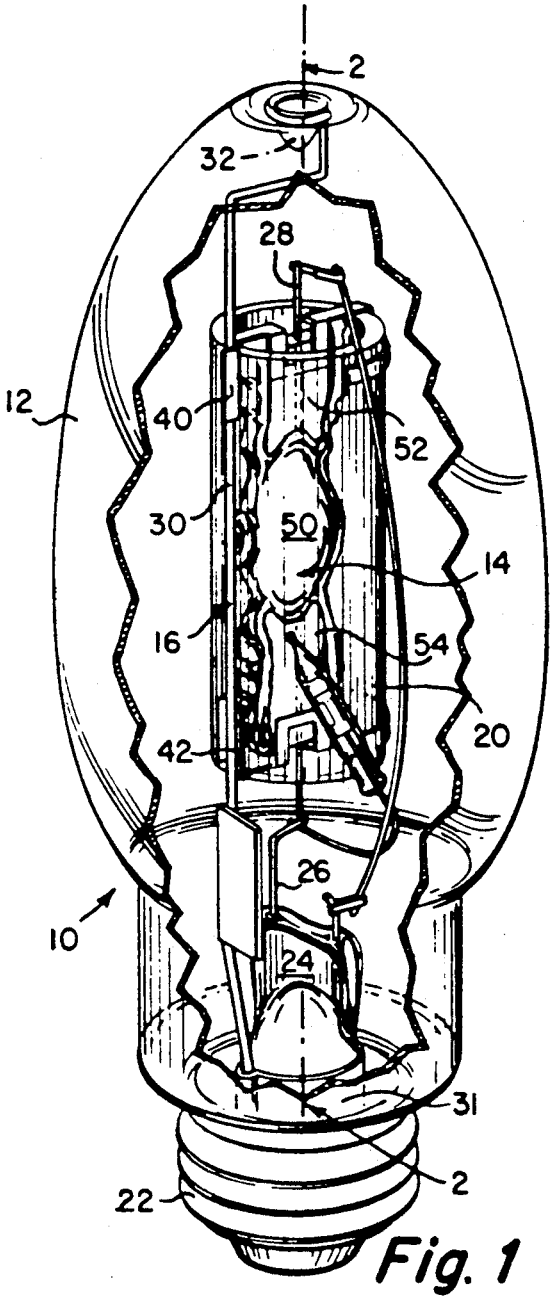
FIG. 1 is a perspective view of a lamp assembly in accordance with a preferred embodiment of the invention.
Figure 2:
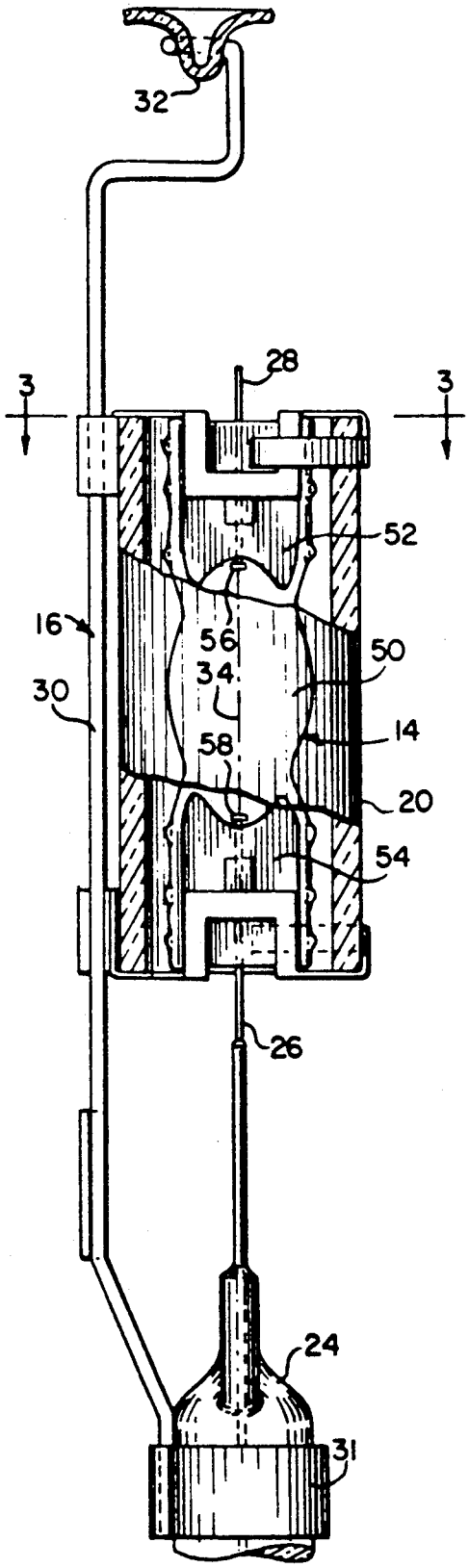
FIG. 2 is an enlarged, partial cross sectional view showing the arc tube, shroud and mounting arrangement, taken along the line 2—2 of FIG. 1.
Figure 3:
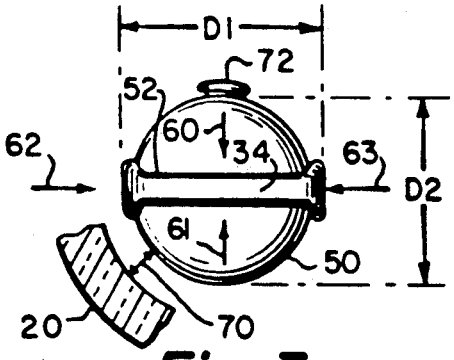
FIG. 3 a cross sectional view showing the arc tube and shroud, taken along the line 3—3 of FIG. 2.

An electric lamp assembly 10 in accordance with a preferred embodiment of the present invention is shown in FIGS. 1-3. The lamp assembly 10 includes an outer envelope 12 and an arc tube, or light source capsule 14, mounted within outer envelope 12 by a mounting means 16. The arc tube 14 is positioned within a shroud 20. The shroud 20 is supported in the lamp assembly 10 by the mounting means 16. Electrical energy is coupled to arc tube 14 through a base 22, a stem 24 and electrical leads 26 and 28. Outer envelope 12 is typically formed from blow molded hard glass having a thickness in the range of 0.025 inch to 0.060 inch. The lamp capsule 14 can be a metal halide arc tube, a tungsten halogen incandescent capsule or any other light-source capsule which is advantageously operated within a shroud. The shroud 20 comprises a cylindrical tube of light-transmissive, heat resistant material such as quartz.

The mounting means 16 mechanically supports both the light-source capsule 14 and the shroud 20 within outer envelope 12. The mounting means 16 secures light-source capsule 14 and shroud 20 in fixed positions so that they cannot move axially or laterally relative to the remainder of the assembly during shipping and handling or during operation. The mounting means 16 includes a metal support rod 30 attached to stem 24 by a strap 31 and attached to a dimple 32 in the upper end of the outer envelope 12. The support rod 30 in its central portion is parallel to a central axis 34 of light-source capsule 14 and shroud 20. The mounting means 16 further includes an upper clip 40 and a lower clip 42 which secure both light-source capsule 14 and shroud 20 to support rod 30. Preferred embodiments of the clips 40 and 42 are disclosed in application Ser. No. 07/539,753, filed Jun. 19, 1990 and assigned to the assignee of the present application, which application is hereby incorporated by reference.

The lamp assembly shown in FIGS. 1-3 has a configuration in accordance with the invention which has been found to provide improved containment performance in comparison with conventional lamp assemblies and which provides other advantages as described below. The light source capsule or arc tube 14 includes a bulb portion 50 and press seals 52 and 54. The bulb portion 50 encloses a sealed discharge region which contains a suitable fill material for maintaining an arc discharge. Electrodes 56 and 58 are positioned at opposite ends of the discharge region. The press seals 52 and 54 are located at opposite ends of the bulb portion 50 and provide sealed electrical feedthroughs from leads 26 and 28 to electrodes 58 and 56, respectively. In the lamp assembly 10 of the present invention, the arc tube 14 is fabricated such that a maximum dimension D1 of each press seal 52, 54 in a direction perpendicular to arc tube axis 34 is not substantially greater than a maximum dimension D2 of bulb portion 50 perpendicular to arc tube axis 34.

The press seals 52 and 54 are preferably formed using a four jawed press tool. With reference to FIG. 3, the press tool includes a first pair of jaws, shown schematically at 60 and 61, for pressing the sides of the heated arc tube 14 together in a first press seal step. The arc tube is then pressed in a second press seal step by a second pair of press jaws, shown schematically at 62 and 63, which press the arc tube 14 in a direction perpendicular to the first press seal step. The press jaws 62 and 63 control the dimension D1 of each of the press seals 52 and 54. As noted above, the dimension D1 of press seal 52 should not be substantially greater than the dimension D2 of bulb portion 50. The press jaws 60-63 are configured to provide a press seals 52 and 54 having cross sections in a plane perpendicular to axis 34 which are generally I-shaped, as shown in FIG. 3. In practice, one pair of press jaws may be utilized for the first and second press seal steps. In this case, the arc tube 14 is rotated by 90° after the first press seal step, with the travel of the press jaws suitably controlled. Techniques for forming press seals in quartz arc tubes are well known in the art.

In accordance with another feature of the invention, a spacing 70 between the outside surface of bulb portion 50 and the inside surface of shroud 20 is limited to no more than about 3 millimeters. The spacing 70 is measured at the widest part of bulb portion 50 away from the arc tube tipoff 72. In prior art lamp assemblies, the spacing 70 between the bulb portion 50 and the shroud 20 was typically about 5 mm. It would normally be expected that containment performance would be degraded by positioning the shroud 20 closer to the bulb portion 50 of the arc tube 14, since fragments of a burst arc tube have higher velocities closer to the arc tube. However, it has unexpectedly been found that this configuration provides improved performance, as described below.

It can be seen that press seals 52 and 54, having controlled dimensions as described above, permit the shroud 20 to be located closer to the bulb portion 50 than in prior art lamp assemblies wherein the width of the press seal was substantially wider than the bulb portion. However, it has been found that the press seal configuration described herein provides improved containment performance independently of alterations to the shroud and shroud spacing.

A further advantage of the controlled width press seals and the reduced spacing between the arc tube and the shroud is that the wall thickness of the shroud 20 can be increased, thereby further improving containment performance. In prior art lamp assemblies with relatively wide press seals and a relatively large spacing between the arc tube and the shroud, it was necessary to limit the shroud wall thickness in order to permit the assembly to be installed through the neck of outer envelope 12.

In summary, the lamp assembly of the present invention includes an arc tube having press seals with a dimension D1 which is not substantially greater than the maximum dimension D2 of the bulb portion of the arc tube. The press seals 52 and 54 have a generally I shaped cross section. The spacing 70 between the outside surface of bulb portion 50 and the inside surface of shroud 20 is not greater than about 3 millimeters. Preferably, the spacing 70 is not less than about 1 millimeter. The shroud 20 preferably has a wall thickness in the range of about 2.5 to 3.0 millimeters. In a preferred embodiment of a 100 watt metal halide lamp, the dimension D1 of the press seals is about 12.5 mm, and the dimension D2 of the bulb portion is about 12.0 mm. Spacing 70 is about 2.5 millimeters, and the wall thickness of shroud 20 is about 2.5 millimeters.

A number of conventional lamp assemblies and lamp assemblies in accordance with the present invention were tested for containment performance. The results are summarized in Table 1. In each case, at least 25 lamps were tested. The arc tube was caused to fail by charging a 30 microfarad capacitor connected to the arc tube to between 1500 and 2000 volts. The containment criteria of Underwriters Laboratories Standard UL 1572, Section 57A.9 was used.

TABLE 1

| Arc Tube | Shroud | Contained Within Outer Envelope | Arc Tube - Shroud Spacing |
|---|---|---|---|
| Standard | 20 mm × 24 mm | 55.0% | 4.0 mm |
| Standard | 20 mm × 24 mm | 55.0% | 4.0 mm |
| Four Jaw | 20 mm × 22 mm | 77.3% | 4.0 mm |
| Four Jaw | 18 mm × 22 mm | 87.0% | 3.0 mm |
| Four Jaw | 18 mm × 22 mm | 100.0% | 3.0 mm |
| | | Silicon Coated Bulb | |
| Four Jaw | 17 mm × 22 mm | 100.0% | 2.5 mm |

Table 1 tabulates the results of experiments leading to the present invention. The shroud dimensions indicate the inside and outside diameters, respectively. The prior art lamps had a standard arc tube and a 20 mm × 22 mm shroud. The first and second trials in Table 1 were tested with the standard arc tube and a shroud with a 2 mm wall thickness in place of a shroud with a 1 mm wall thickness. The third trial used a four jaw press arc tube with the standard shroud having a 1 mm wall thickness. Since containment improvements were observed in the third trial, further studies were conducted with thicker wall shrouds, as indicated by trials four through six. In the fifth trial in Table 1, the outer jacket was coated with silicon rubber. It is seen from Table 1 that containment performance improved significantly for all embodiments of the present invention that were tested in comparison with prior art lamp assemblies.

Another unexpected result of the reduced spacing between the arc tube outer diameter and the shroud inner diameter relates to a failure mode when the lamp assemblies are operated in a horizontal position. Lamp assemblies operated in a horizontal position sometimes result in the arc tube expanding or bulging due to high wall loading. The upper portion of the arc tube expands, thereby weakening the quartz to the point where it eventually bursts. It will be understood that the mode of failure wherein the arc tube bulges in a localized region and eventually bursts occurs more frequently in the horizontal position, but can also occur when the lamp is operated in a vertical position. When the spacing between the arc tube outside diameter and the shroud inside diameter is reduced as described above, the lamp assembly has been found to fail without bursting. When the arc tube expands but before the quartz is sufficiently weakened to burst, the arc tube contacts the shroud in the region of the bulge. The contact causes the arc tube to crack and to fail in a passive mode without bursting.

The lamp configuration shown and described herein is considered most useful for metal halide arc lamps in a wattage range between about 75 and 400 watts, but is not limited to such a wattage range. It is believed that the change in failure mode wherein a bulge in the arc tube contacts the shroud and thereby produces a passive failure is applicable to any lamp wattage.

While there have been shown and described what are at present considered the preferred embodiments of the present invention, it will be obvious to those skilled in the art that various changes and modifications may be made therein without departing from the scope of the invention as defined by the appended claims.

What is claimed is:

1. A double-enveloped lamp comprising:

(a) a hermetically sealed light transmissive outer envelope enclosing an interior, said outer envelope being elongated along a central axis, said outer envelope including a body and a neck, said neck having an inside diameter in a plane perpendicular to said central axis;

(b) an internal lamp assembly mounted within said outer envelope substantially parallel to said central axis, said assembly having a maximum outer diameter in a plane perpendicular to said central axis, said outer diameter of said assembly being slightly less than said inside diameter of said neck such that said assembly may be inserted through said neck during manufacture of said lamp, said assembly further including:

(i) a light-source capsule mounted substantially along said central axis, said light-source capsule having a bulb portion enclosing a discharge region and press seals at opposite ends of said bulb portion, said bulb portion having an outer diameter in a plane perpendicular to said central axis, said press seals having a maximum dimension in a plane perpendicular to said central axis such that said maximum dimension is not substantially greater than said outer diameter of said bulb portion, said light-source capsule being subject to burst on rare occasions;

(ii) containment means mounted along said central axis and surrounding said light-source capsule, said containment means being a light-transmissive shroud having an inside diameter, said inside diameter of said shroud being not more than about three millimeters greater than said outside diameter of said bulb portion of said light-source capsule; said shroud having a wall thickness of about 2.0 millimeters or greater; and (c) means for structurally and electrically completing said lamp.

2. A double-enveloped lamp as described in claim 1 wherein one of said press seals has a generally I-shaped cross section in a plane perpendicular to said central axis of said lamp.

3. A double-enveloped lamp as described in claim 1 wherein said shroud is generally cylindrical and the wall thickness of said cylindrical shroud is in the range of about 2.5 to 3.0 millimeters.

4. A double-enveloped lamp as described in claim 1 wherein said light-source capsule is a metal-halide arc tube.

* * * * *